US010724370B2

(12) United States Patent
Lavely et al.

(10) Patent No.: US 10,724,370 B2
(45) Date of Patent: Jul. 28, 2020

(54) SMART CUTTING DRUM ASSEMBLY

(71) Applicant: Kennametal Inc., Latrobe, PA (US)

(72) Inventors: Brian Lavely, Ebensburg, PA (US); Chad Swope, Bedford, PA (US)

(73) Assignee: KENNAMETAL INC., Latrobe, PA (US)

( * ) Notice: Subject to any disclaimer, the term of this patent is extended or adjusted under 35 U.S.C. 154(b) by 9 days.

(21) Appl. No.: 15/373,212

(22) Filed: Dec. 8, 2016

(65) Prior Publication Data

US 2017/0159432 A1 Jun. 8, 2017

Related U.S. Application Data

(60) Provisional application No. 62/264,367, filed on Dec. 8, 2015.

(51) Int. Cl.

| | |
|---|---|
| ***E21C 35/18*** | (2006.01) |
| ***B28D 7/00*** | (2006.01) |
| ***G07C 3/00*** | (2006.01) |
| ***E21C 39/00*** | (2006.01) |
| ***B28D 1/18*** | (2006.01) |
| ***G07C 5/08*** | (2006.01) |

(52) U.S. Cl.

CPC ..... *E21C 35/18* (2013.01); *B28D 1/186* (2013.01); *B28D 7/00* (2013.01); *E21C 39/00* (2013.01); *G07C 3/00* (2013.01); *G07C 5/0808* (2013.01); *G07C 5/0841* (2013.01)

(58) Field of Classification Search

CPC ..... E21C 35/18

See application file for complete search history.

(56) References Cited

U.S. PATENT DOCUMENTS

| | | | | |
|---|---|---|---|---|
| 2,620,386 A | | 12/1952 | Alspaugh | |
| 2,741,468 A | * | 4/1956 | Alspaugh | B23Q 17/0985 175/24 |
| 3,015,477 A | | 1/1962 | Persson | |
| 3,102,718 A | | 9/1963 | Eberle | |
| 3,333,893 A | | 8/1967 | Heimaster | |
| 3,512,838 A | * | 5/1970 | Kniff | E21C 35/19 299/104 |

(Continued)

FOREIGN PATENT DOCUMENTS

| | | |
|---|---|---|
| CN | 103481247 A | 1/2014 |
| CN | 104405391 A | 6/2016 |

(Continued)

OTHER PUBLICATIONS

Sep. 5, 2017 First office action.
Jul. 30, 2019 Foreign OA.
Apr. 23, 2020 Office Action (non-US) CN App. No. 107008544A.

*Primary Examiner* — Janine M Kreck
(74) *Attorney, Agent, or Firm* — Matthew S. Bedsole

(57) ABSTRACT

A cutting tool mounting assembly adapted for attachment to a surface of a rotatable driving member of a cutting tool machine. The cutting tool mounting assembly includes: a cutting tool; a base having a bottom portion for attachment to the surface of the rotatable driving member and a front portion that defines a receptacle having an inner wall; a bushing configured for receipt in the receptacle of the base and having an aperture for receiving the cutting tool; and a sensor element for acquiring and transmitting operation data.

16 Claims, 9 Drawing Sheets

(56) References Cited

U.S. PATENT DOCUMENTS

| | | | | | |
|---|---|---|---|---|---|
| 3,550,959 | A | | 12/1970 | Alford | |
| 3,591,235 | A | | 7/1971 | Addison | |
| 3,901,574 | A | | 8/1975 | Paullus | |
| 4,001,798 | A | * | 1/1977 | Robinson | G01L 1/16 340/870.18 |
| 4,181,360 | A | | 1/1980 | Wilson | |
| 4,201,421 | A | * | 5/1980 | Den Besten | E21C 35/197 175/354 |
| 4,367,899 | A | | 1/1983 | Whittaker | |
| 4,368,919 | A | | 1/1983 | Whittaker | |
| 4,655,082 | A | | 4/1987 | Peterson | |
| 4,733,915 | A | * | 3/1988 | Hedlund | E21C 35/23 299/81.2 |
| 4,968,098 | A | | 11/1990 | Hirsch | |
| 5,092,657 | A | | 3/1992 | Bryan, Jr. | |
| 5,098,167 | A | * | 3/1992 | Latham | E21C 35/1933 299/104 |
| 6,717,501 | B2 | | 4/2004 | Hall | |
| 7,159,804 | B2 | | 1/2007 | Macaluso | |
| 7,887,142 | B2 | | 2/2011 | Hall | |
| 8,246,270 | B2 | | 8/2012 | Berning | |
| 8,738,304 | B2 | | 5/2014 | Hall | |
| 9,145,741 | B2 | | 9/2015 | Trinh | |
| 9,670,649 | B2 | | 6/2017 | Bewley | |
| 9,695,642 | B2 | | 7/2017 | Hay | |
| 9,920,624 | B2 | | 3/2018 | Doheny, II | |
| 2007/0192112 | A1 | | 8/2007 | Hall | |
| 2011/0268503 | A1 | | 11/2011 | Hall | |
| 2013/0068525 | A1 | | 3/2013 | DiGiovanni | |
| 2013/0234494 | A1 | * | 9/2013 | Hall | E21C 35/18 299/29 |
| 2013/0270890 | A1 | * | 10/2013 | Hall | E21C 35/18 299/79.1 |
| 2016/0237640 | A1 | | 8/2016 | Carpenter | |

FOREIGN PATENT DOCUMENTS

| | | | | | |
|---|---|---|---|---|---|
| CN | 107008544 | A | | 8/2017 | |
| DE | 4415824 | C1 | | 11/1995 | |
| DE | 19547698 | C2 | | 8/2000 | |
| DE | 102005010678 | B4 | | 12/2006 | |
| DE | 102016123755 | A1 | | 6/2017 | |
| GB | 1219159 | A | * | 1/1971 | E21C 39/00 |
| GB | 2036127 | | | 6/1980 | |
| GB | 2036127 | A | * | 6/1980 | E21C 35/10 |

* cited by examiner

SMART CUTTING DRUM ASSEMBLY

RELATED APPLICATIONS

This application claims priority to the U.S. provisional patent application associated with Ser. No. 62/264,367 filed Dec. 8, 2015. The contents of the foregoing application are incorporated herein by reference in their entirety.

BACKGROUND OF THE INVENTION

The present invention relates to cutting drums and cutting tools and cutting tool assemblies used for mining and construction and, more particularly, relates to a smart cutting drum assembly having such cutting drums and cutting tools and cutting tool assemblies.

Rotatable and/or non-rotatable cutting tools are used in conjunction with a machine used to break up (or cut) a substrate such as coal, rock, asphalt pavement, asphaltic concrete, concrete or the like. In its very basic aspects, such a machine includes a driven member (e.g., a chain, a wheel or a drum), a block and/or holder either directly or indirectly mounted to the driven member, a rotatable or non-rotatable cutting tool held in the block/holder, and typically a bushing element therebetween. It is the cutting tool that impinges the substrate so as to break it into pieces upon impact.

As known to those skilled in the art, the cutting environment in which such cutting drums assemblies and cutting tools and cutting tool assemblies are used is harsh and results in significant wear. The wear, along with other operating parameters, is usually difficult to monitor or observe during operation of the machine. When components break or need replaced due to wear, it can result in loss of operation time.

Accordingly, it will be appreciated that improved cutting drum assemblies and cutting tool assemblies and/or related components which can monitor wear, usage, and/or other operating parameters that overcome limitations, shortcomings and disadvantages of known cutting drums and cutting tool assemblies and/or related components would be desirable.

SUMMARY OF THE INVENTION

In accordance with an aspect of the invention, a cutting tool mounting assembly adapted for attachment to a surface of a rotatable driving member of a cutting tool machine, the cutting tool mounting assembly including: a cutting tool; a base having a bottom portion for attachment to the surface of the rotatable driving member and a front portion that defines a receptacle having an inner wall; a bushing configured for receipt in the receptacle of the base and having an aperture for receiving the cutting tool; and a sensor element for acquiring operation data.

In accordance with another aspect of the invention, a cutting tool mounting assembly adapted for attachment to a surface of a rotatable driving member of a cutting tool machine, the cutting tool mounting assembly including: a cutting tool; a base configured for receiving the cutting tool and having a bottom portion for attachment to the surface of the rotatable driving; and means for acquiring operation data pertaining to the cutting tool machine and/or cutting tool mounting assembly.

In accordance with yet another aspect of the invention, a cutting tool mounting assembly adapted for attachment to a surface of a rotatable driving member of a cutting tool machine and adapted for receiving a cutting tool, the cutting tool mounting assembly including: a base configured for receiving the cutting tool and having a bottom portion for attachment to the surface of the rotatable driving; and means for acquiring operation data.

In accordance with yet another aspect of the invention, sensors will be mounted within the cutting system which can include the drum, block, pedestal, pick (i.e., cutting tool), or bushing. The sensors would be capable of sending real-time wireless data of test, measurement, and control information to a wireless receiver. The sensors would primarily include, for example, a power source, sensors, and a wireless transceiver. Types of sensors to be used, but not limited to, vibration, temperature, torque, and inertia. The data from the sensors can then be used to determine but not limited to, conical life, and bore life of the sleeve and/or block. This information can be used to help inform miners of when tools need to be replaced and aid in the overall safety of the mining process and improve process control.

These and other aspects of the present invention will be more fully understood following a review of this specification and drawings.

BRIEF DESCRIPTION OF THE DRAWINGS

FIG. 1 additionally shows a partial cross-section or cutaway of certain portions of the tool mounting assembly.

DETAILED DESCRIPTION

Figure 1:
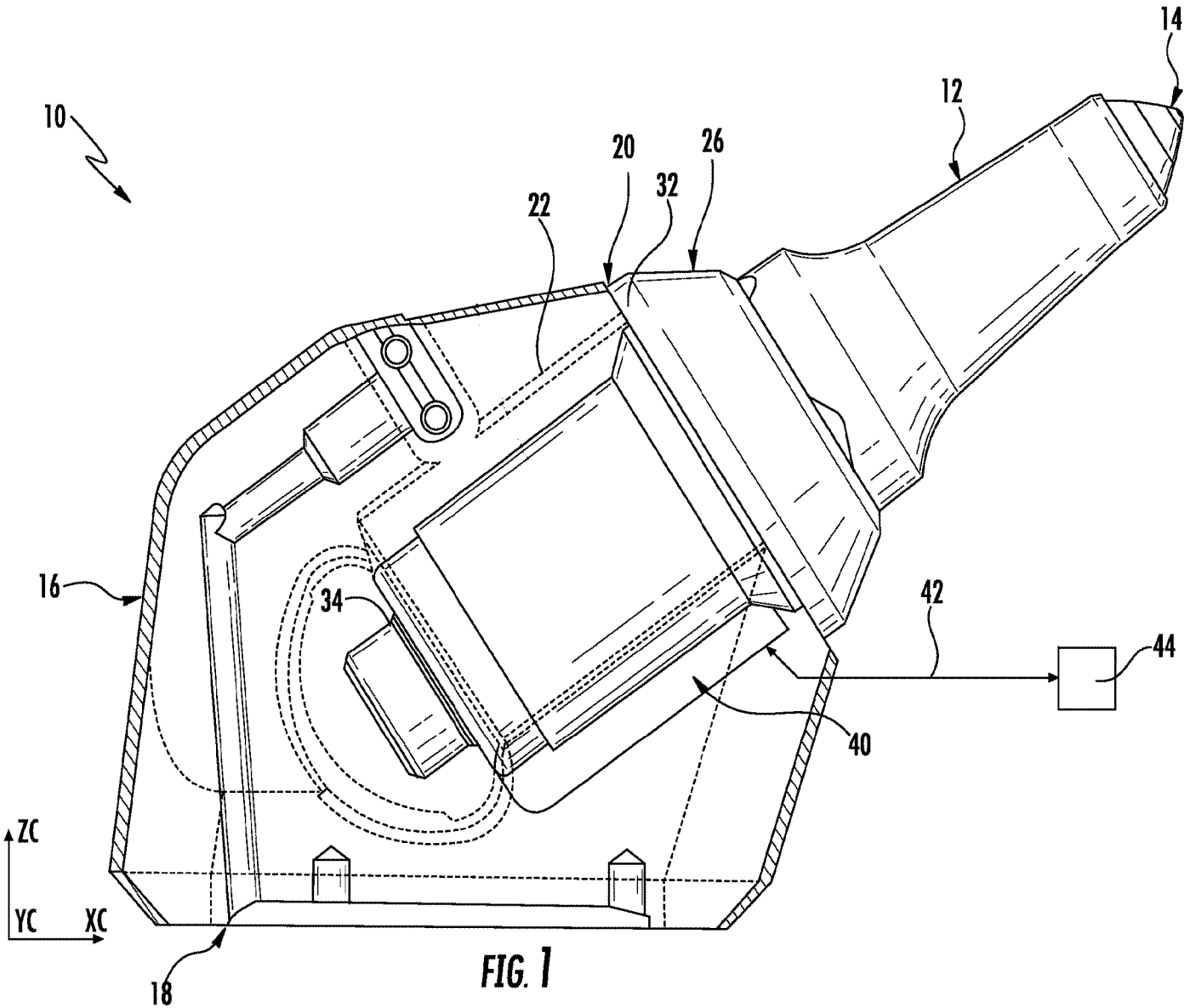
FIG. 1 illustrates a side view of a cutting tool mounting assembly consistent with one embodiment of the invention.
Figure 2:
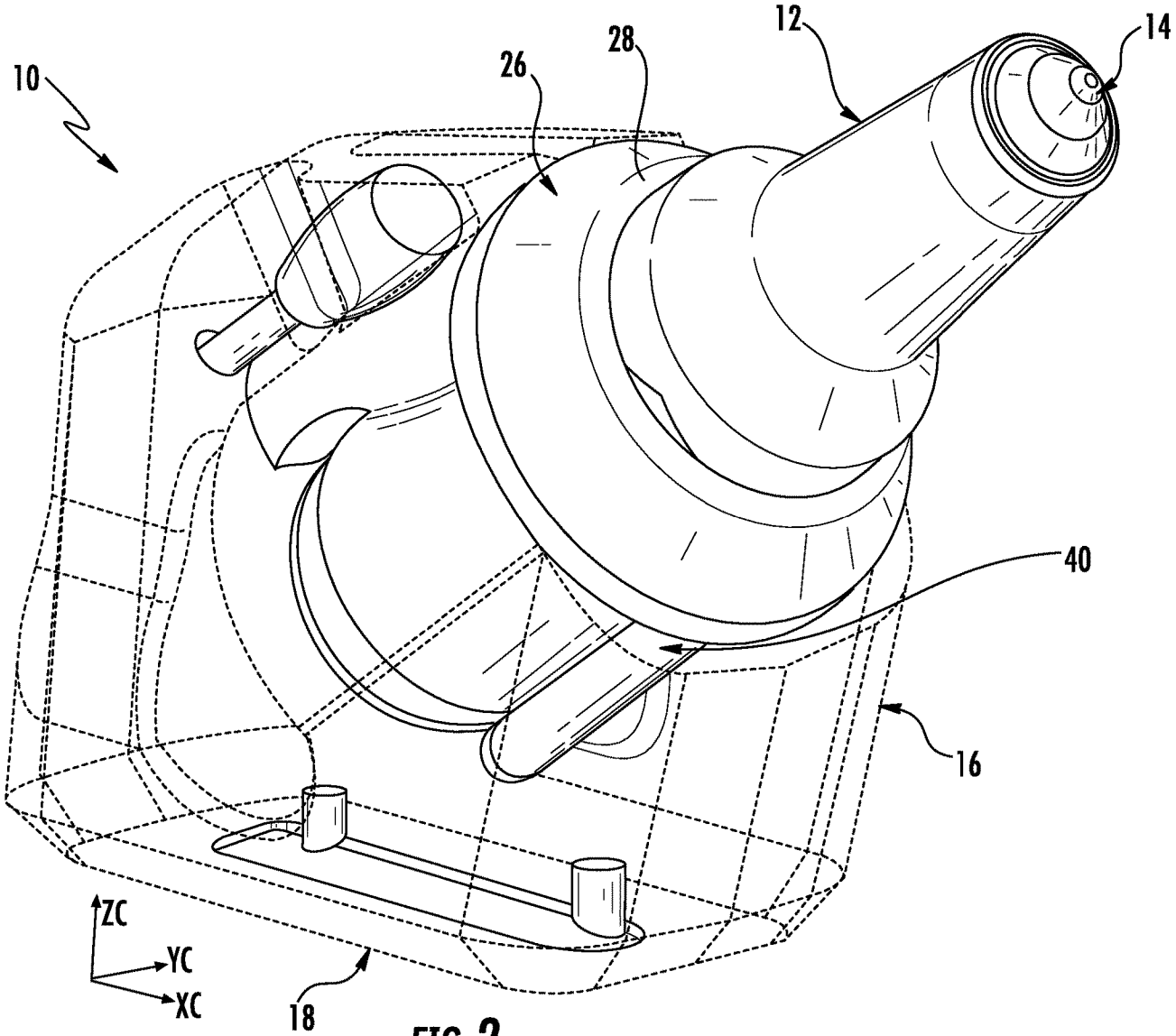
FIG. 2 illustrates a perspective and partial cross-sectional view of the tool mounting assembly of FIG. 1.
Figure 3:
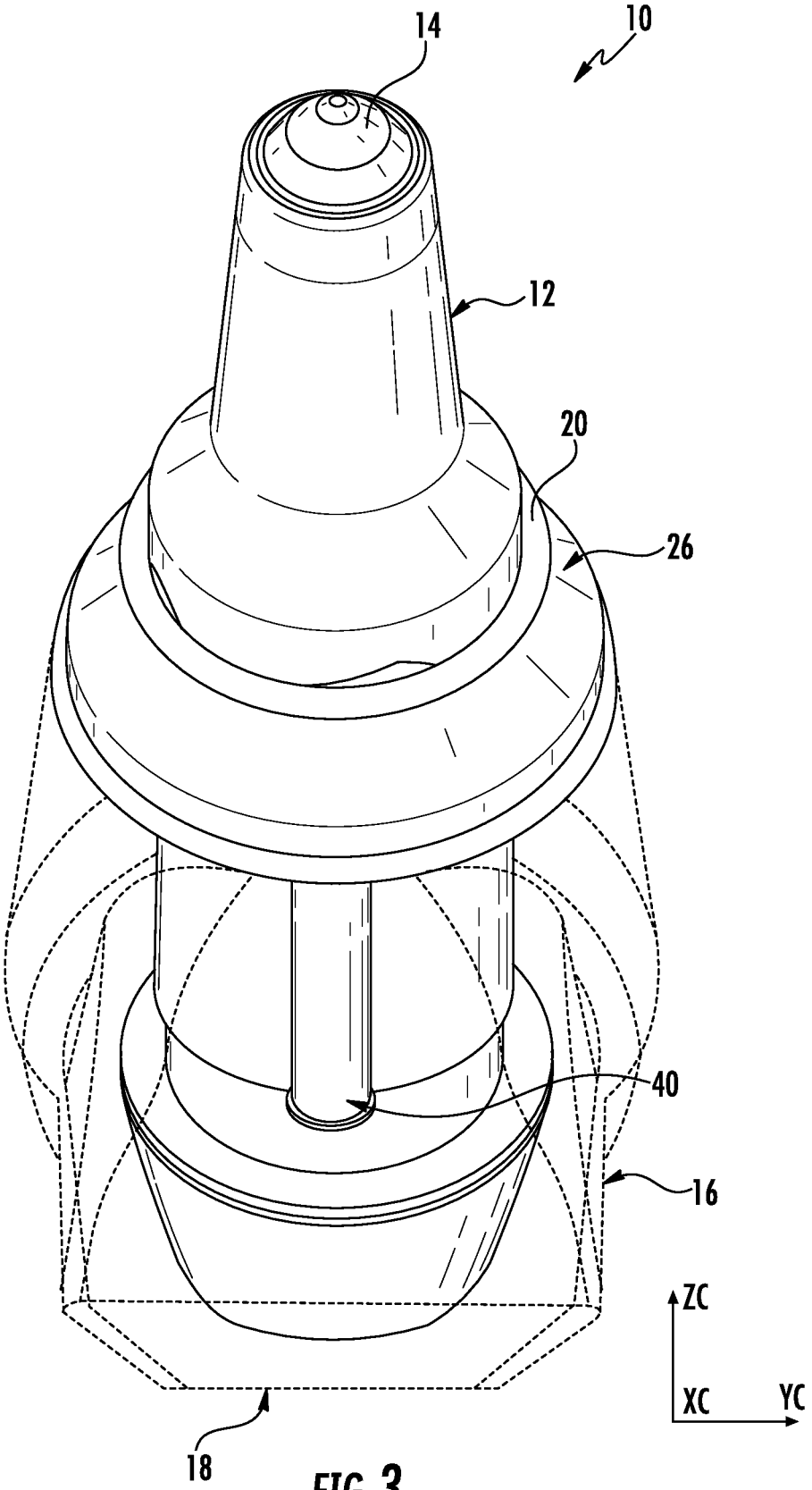
FIG. 3 illustrates a perspective and partial cross-sectional view of the tool mounting assembly of FIG. 1.
Figure 4:
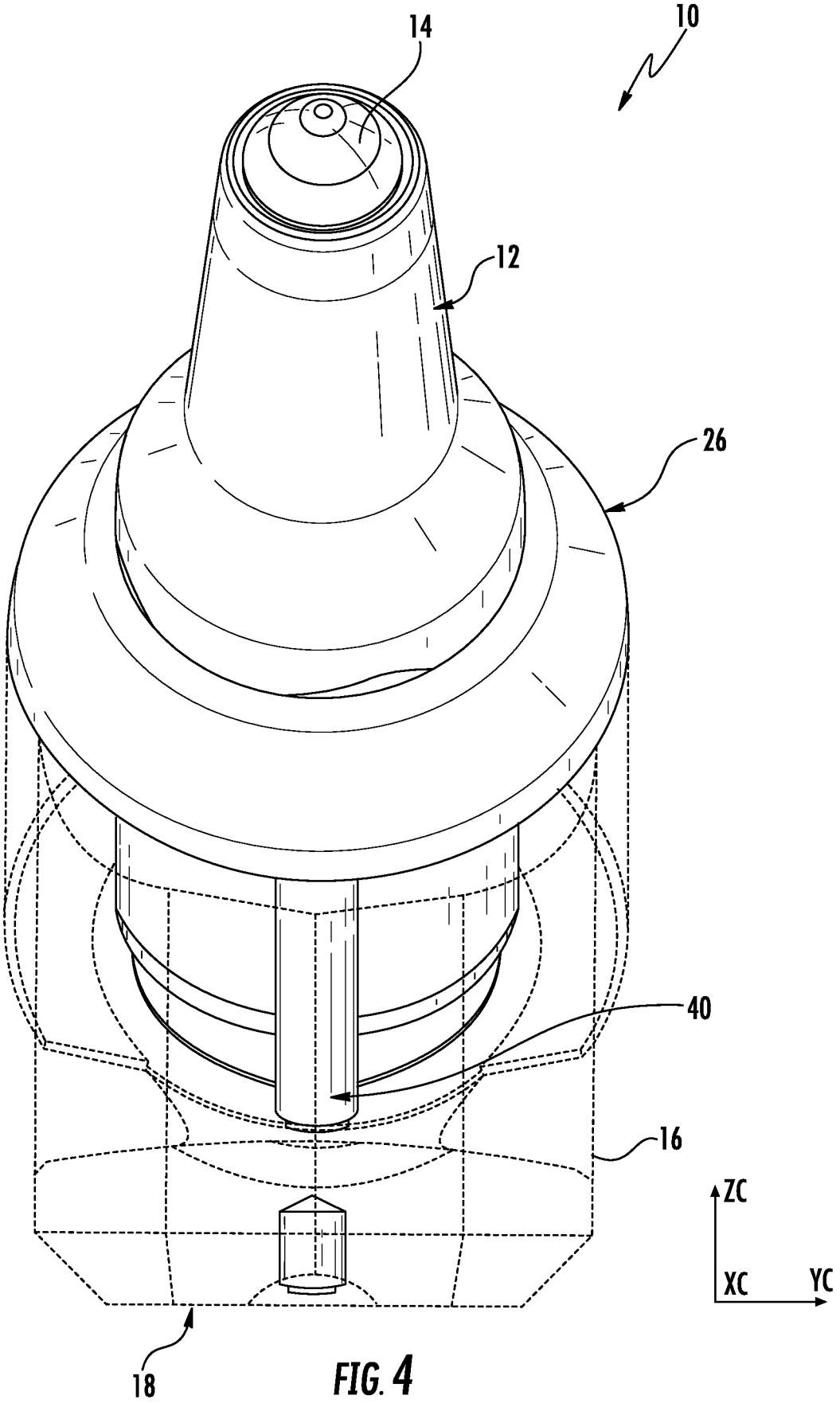
FIG. 4 illustrates a perspective and partial cross-sectional view of the tool mounting assembly of FIG. 1.
Figure 5:
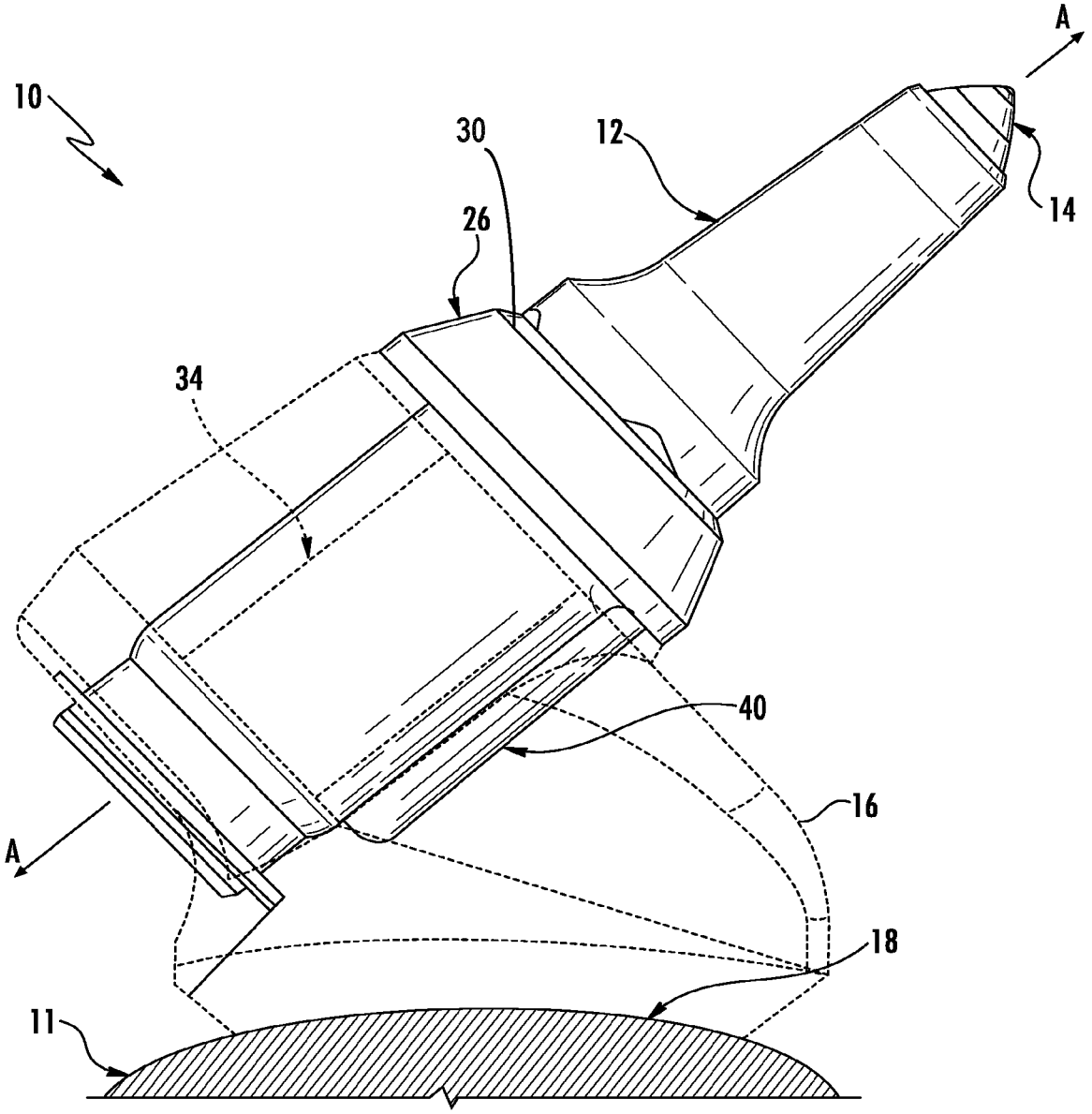
FIG. 5 illustrates a side and partial cross-sectional view of the tool mounting assembly of FIG. 1.
Figure 6:
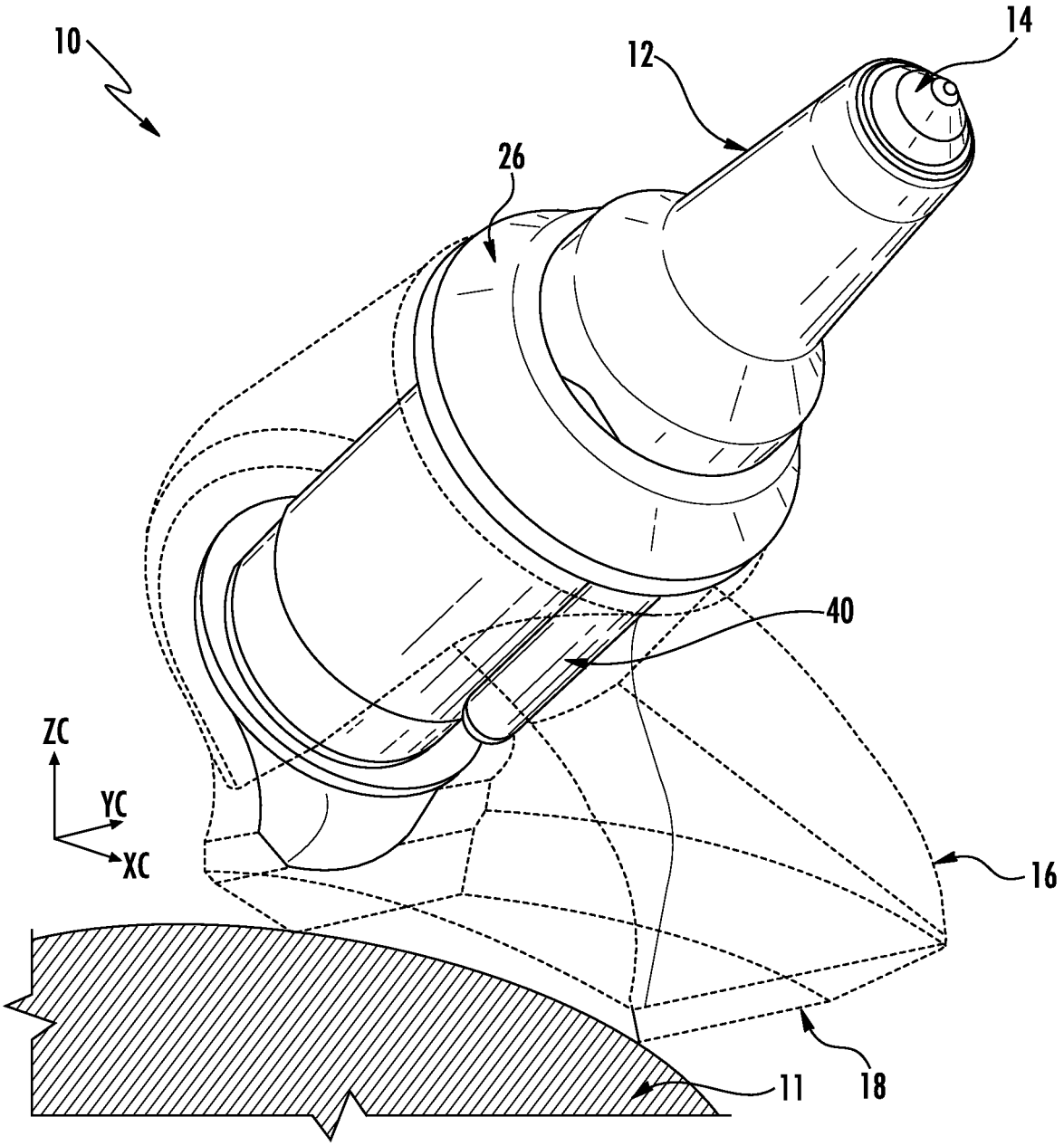
FIG. 6 illustrates a perspective and partial cross-sectional view of the tool mounting assembly of FIG. 1.
Figure 7:
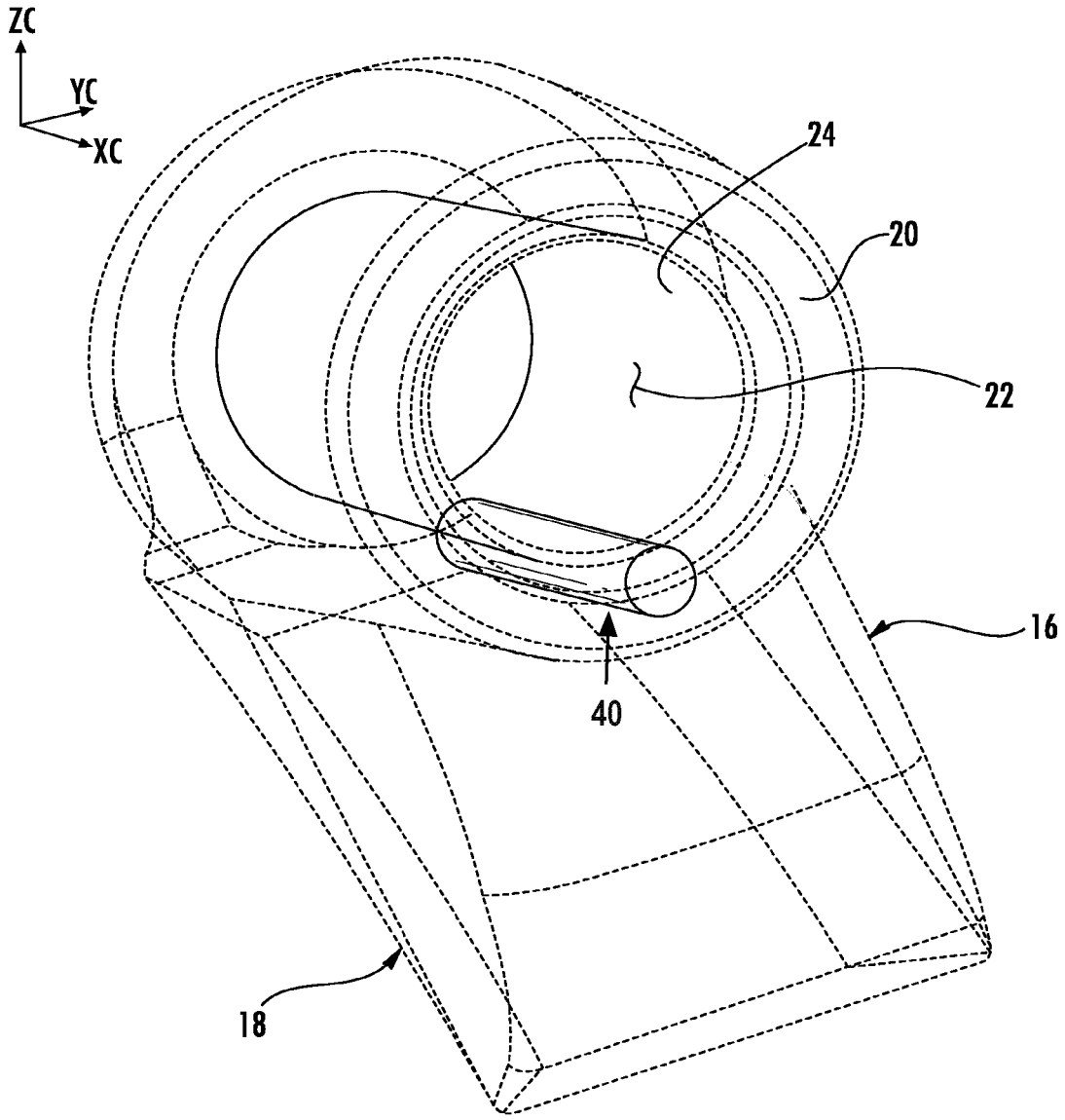
FIG. 7 illustrates a perspective and partial cross-sectional view a portion of the cutting tool mounting assembly of FIG. 1.
Figure 8:
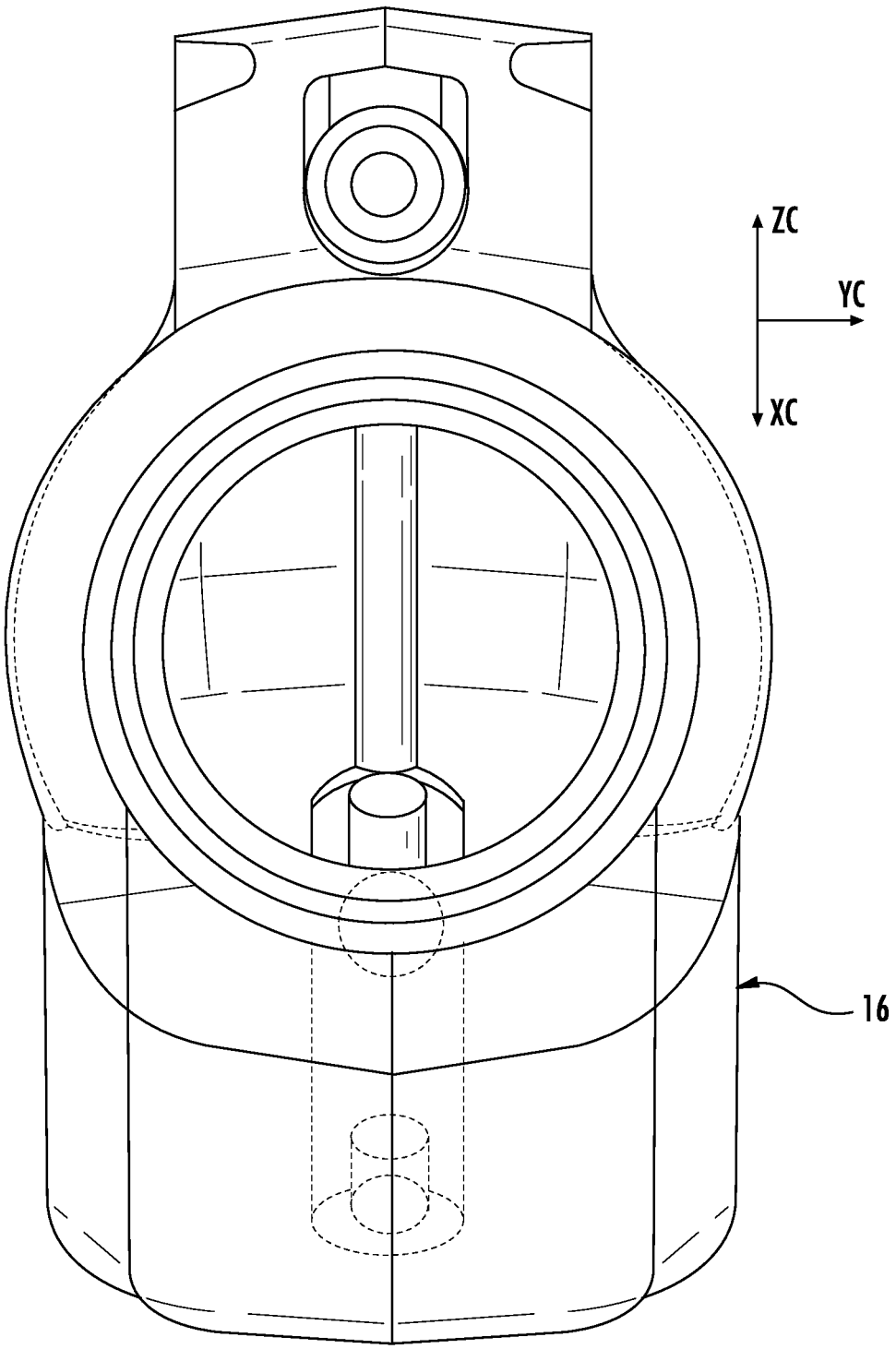
FIG. 8 illustrates a perspective and partial cross-sectional view a portion of the cutting tool mounting assembly of FIG. 1.
Figure 9:
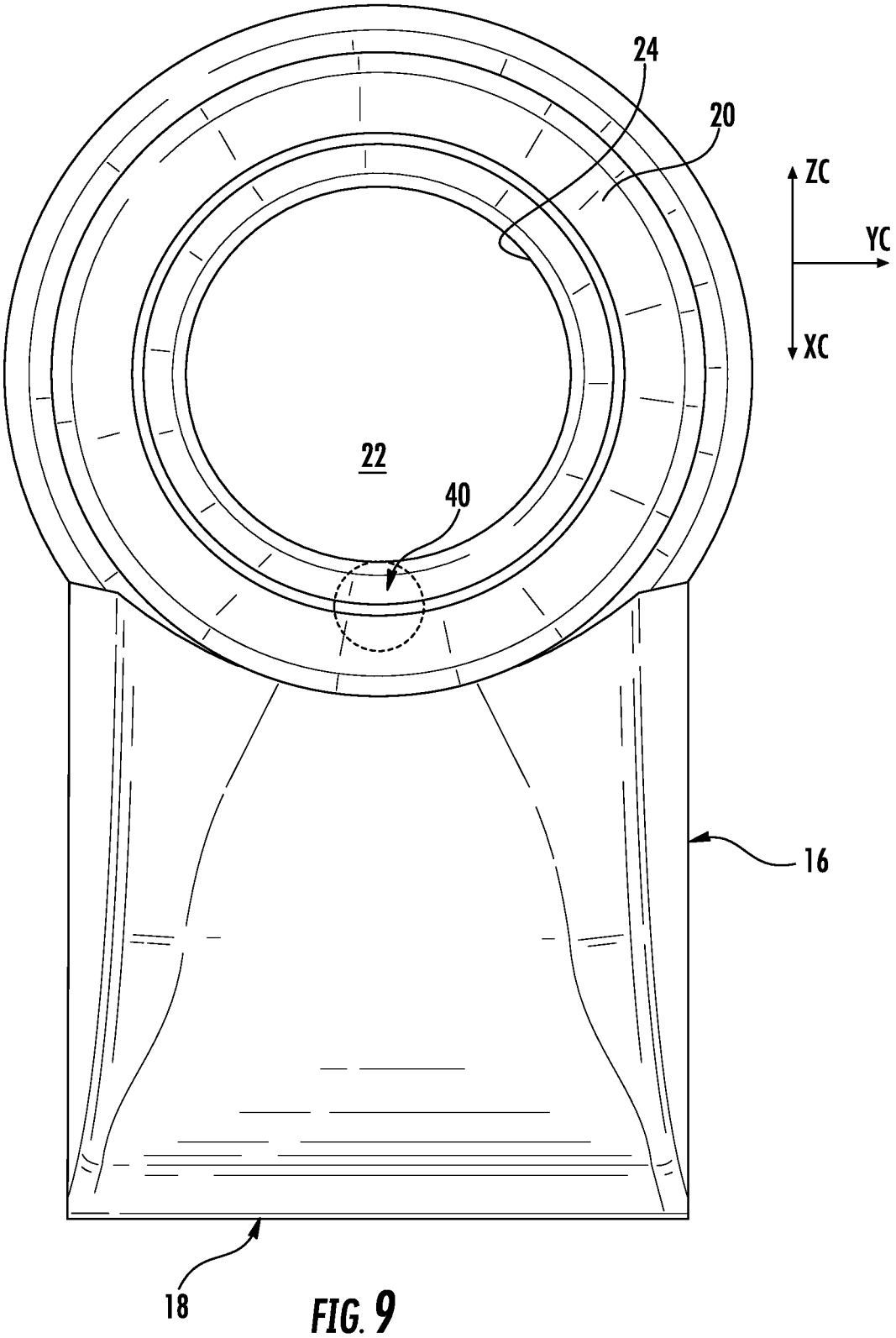
FIG. 9 illustrates a perspective and partial cross-sectional view a portion of the cutting tool mounting assembly of FIG. 1.

Embodiments described herein can be understood more readily by reference to the following detailed description and examples and their previous and following descriptions. Elements and apparatus described herein, however, are not limited to the specific embodiments presented in the detailed description. It should be recognized that these embodiments are merely illustrative of the principles of the present invention. Numerous modifications and adaptations will be readily apparent to those of skill in the art without departing from the spirit and scope of the invention.

Referring to the Figures, there is illustrated a cutting tool assembly or cutting tool mounting assembly, generally designated as reference number 10, in accordance with various aspects of the invention. As will be apparent following a description of the invention herein, when referring generally to a "cutting tool mounting assembly" adapted for attachment to a surface of a rotatable driving member of a cutting tool machine the invention generally includes, for example, a base configured for attachment to the surface of the rotatable driving member, bushing configured for receipt in the base and a cutting tool configured for receipt in the bushing. For simplification of description of the invention herein, these aspects of the invention may be generally referred to as an "assembly."

It will be appreciated that the invention has application to various kinds of cutting tools useful in various kinds of cutting operations. Exemplary operations include, without limitation, road planing (or milling), coal mining, concrete cutting, and other kinds of cutting operations wherein a cutting tool with a hard cutting member impinges against a substrate (e.g., earth strata, pavement, asphaltic highway material, concrete, minerals and the like) breaking the substrate into pieces of a variety of sizes including larger-size pieces or chunks and smaller-sized pieces including dust-like particles. In addition, it will be appreciated that the cutting tool mounting assembly 10 of the invention, and components thereof, may be manufactured in various sizes and dimensions depending upon the desired application of the assembly 10.

Referring to the Figures, there is illustrated in detail the assembly 10 and various components of the invention. The assembly 10 is adapted for attachment to a surface of a rotatable driving member 11 of a cutting machine (not shown) such as, for example, a mining machine. The assembly 10 is attached or connected to the rotatable driving member such as, for example, a rotating drum by methods well known in the art such as, for example, welding. The assembly 10 is configured for mounting or receiving a cutting tool 12 with a hard cutting member 14 for impinging against a substrate, e.g., earth strata, pavement, asphaltic highway material, concrete, minerals and the like as is well known in the art.

The assembly 10 includes a base 16. The base 16 includes a bottom surface or bottom portion 18 and a front portion 20 that defines a receptacle 22. The receptacle 22 includes an inner surface or inner wall 24.

The assembly 10 also includes a bushing 26 configured to be received in the receptacle 22 of the base 16. Typically, the bushing 26 is press fit into the receptacle 22 of the base 16. In one aspect, the bushing 26 is configured to be releasably received in the receptacle 22 so that the bushing 26 receives most of the impact and wear from the cutting tool 12 during operation and therefore reduces or minimizes wear on the base 16. Then bushing 26 can be removed and replaced as needed.

The bushing 26 includes a forward face 28 that defines an aperture 30 for receiving the cutting tool 12. In addition, the bushing 26 includes a shoulder 32 generally opposite the forward face 28. The shoulder 32 is configured for cooperating with the front portion 20 of the base 16. The bushing 26 also includes a shank portion 34 extending generally rearward from the shoulder 32. In one aspect, the shank portion 34 has an outer surface configured for cooperating with the inner wall 24 of the receptacle 22 when the bushing 26 is inserted in the receptacle 22. In another aspect, the shank portion 34 is generally cylindrical. However, the shank portion 34 can be other shapes such as, for example, triangular or quadrilateral as well.

The assembly 10 can have a central longitudinal axis A-A that passes centrally through the cutting tool 12, aperture 30 of the bushing 26 and receptacle 22 of the base 16.

In accordance with the invention, the assembly 10 includes means for acquiring operation data pertaining to the cutting tool machine and/or cutting tool mounting assembly 10. In one aspect, the means for acquiring operation data can be positioned in, on and/or adjacent the cutting tool machine. In another aspect, the means for acquiring operation data can be positioned in, on and/or adjacent the cutting tool mounting assembly 10. The assembly 10 further includes means for transmitting data from the means for acquiring operation data and further including means for processing data from the means for acquiring operation data. Means for transmitting data can include wired and/or wireless transmission (such as, but not limited to, radio waves and/or other electromagnetic wavelength ranges), which may or may not include one or more routers or data relays to transmit the data from the means for acquiring operation data to the means for processing data.

In accordance with an aspect of the invention, the means for acquiring operation data pertaining to the cutting tool machine and/or cutting tool mounting assembly 10 can include a sensor, a sensor element, a sensor assembly or like comparable devices (generally designated as reference number 40). In one aspect, the sensor element 40 can be positioned in, on and/or adjacent the base 16. In another aspect, the sensor element 40 can be positioned in, on and/or adjacent the cutting tool 12. In yet another aspect, the sensor element 40 can be positioned in, on and/or adjacent the bushing 26. Any sensor, sensor element, sensor assembly or like comparable devices consistent with the objectives of the present invention can be used. For example, in some embodiments, the sensors are capable of sending real-time wireless data of test, measurement, and/or control information to a wireless receiver. Sensors, sensor elements, or sensor assemblies can include, but are not limited to, vibration, temperature, torque, and inertia sensors, sensor elements, and/or sensor assemblies Means for acquiring operation data can, in some embodiments, be adapted to acquire specific types of data depending on the desired application or critical metric of the cutting tool. For example, in some embodiments, data acquired may pertain to conical life of the cutting tool. In certain other embodiments, data acquired may pertain to bore life of the sleeve and/or block of the cutting tool mounting assembly. Sensors usable in means for acquiring operation data can comprise or be formed from any elements not inconsistent with the objectives of the present invention. For example, in some embodiments, a sensor, sensor element, and/or sensor assembly can comprise or consist of a power source, one or more sensors, and a transceiver, such as a wireless transceiver.

In one particular aspect, the sensor element 40 is configured for acquiring data pertaining to the cutting tool 12. In another particular aspect, the sensor element 40 is configured for acquiring data pertaining to the cutting tool machine and/or the cutting tool assembly 10.

In another aspect, the sensor element 40 can be configured for transmitting any data obtained thereby. For example, the sensor element 40 can include a transmitting device for sending and/or receiving a signal (generally designated by reference number 42) to a means for processing data from the sensor element which can be any suitable type of computer, tablet or general processing device (generally designated by reference number 44), as shown, for example, in FIG. 1. A means for processing data can, in some embodiments, include a base station or other relay point that may initially receive sensor data and then relay/transmit the same to a processing unit via a wireless or wired connection.

Whereas particular aspects of this invention have been described above for purposes of illustration, it will be evident to those skilled in the art that numerous variations of the details of the present invention may be made without departing from the invention.

Various embodiments of the invention have been described in fulfillment of the various objects of the invention. It should be recognized that these embodiments are merely illustrative of the principles of the present invention. Numerous modifications and adaptations thereof will be readily apparent to those skilled in the art without departing from the spirit and scope of the invention.

The invention claimed is:

1. A cutting tool mounting assembly adapted for attachment to a surface of a rotatable driving member of a cutting tool machine, the cutting tool mounting assembly comprising:

a cutting tool, the cutting tool defining a central longitudinal axis and being rotatable around the central longitudinal axis;

a base having a bottom portion for attachment to the surface of the rotatable driving member and a front portion having a receptacle with an inner wall;

a bushing inserted in the receptacle of the base and allowing the cutting tool to be rotatably disposed therein, the bushing including a forward face having an aperture for receiving the cutting tool, the bushing further including a shoulder opposite the forward face for cooperating with the front portion of the base, and a shank portion extending rearwardly from the shoulder and having an outer surface for cooperating with the inner wall of the receptacle when the bushing is inserted in the receptacle; and a sensor element for acquiring operation data, wherein the sensor element is disposed external to and in physical contact with the outer surface of the shank portion of the bushing.

2. The cutting tool mounting assembly of claim 1, wherein the sensor element is configured for acquiring data pertaining to the cutting tool machine.

3. The cutting tool mounting assembly of claim 1, wherein the sensor element is configured for transmitting data pertaining to the cutting tool.

4. The cutting tool mounting assembly of claim 1, further including means for processing data from the sensor.

5. The cutting tool mounting assembly of claim 1, wherein the sensor element has a longitudinal axis that extends substantially parallel to the central longitudinal axis of the cutting tool.

6. The cutting tool mounting assembly of claim 1, wherein the sensor element is adjacent the receptacle of the base, and wherein a portion of the sensor element extends through the receptacle so as to be in physical contact with the cutting toolouter surface of the bushing.

7. A cutting tool mounting assembly adapted for attachment to a surface of a rotatable driving member of a cutting tool machine, the cutting tool mounting assembly comprising:

a cutting tool, the cutting tool defining a central longitudinal axis and being rotatable around the central longitudinal axis;

a base configured for receiving the cutting tool and having a bottom portion for attachment to the surface of the rotatable driving, the base having a receptacle with an inner wall for receiving the cutting tool;

a bushing inserted in the receptacle of the base and allowing the cutting tool to be rotatably disposed therein, the bushing including a forward face having an aperture for receiving the cutting tool, the bushing further including a shoulder opposite the forward face for cooperating with the front portion of the base, and a shank portion extending rearwardly from the shoulder and having an outer surface for cooperating with the inner wall of the receptacle when the bushing is inserted in the receptacle; and means for acquiring operation data pertaining to the cutting tool machine and/or cutting tool mounting assembly, wherein the means for acquiring operation data pertaining to the cutting tool machine and/or cutting tool mounting assembly is disposed external to and in physical contact with the bushing such that a longitudinal axis of means for acquiring operation data is substantially parallel to the central longitudinal axis of the cutting tool.

8. The cutting tool mounting assembly of claim 7, further including means for transmitting data from the means for acquiring operation data.

9. The cutting tool mounting assembly of claim 7, further including means for processing data from the means for acquiring operation data.

10. The cutting tool mounting assembly of claim 7, wherein the means for acquiring operation data has a longitudinal axis that extends substantially parallel to the central longitudinal axis of the cutting tool.

11. The cutting tool mounting assembly of claim 7, wherein the means for acquiring operation data is adjacent the receptacle of the base, and wherein a portion of the means for acquiring operation data extends through the receptacle so as to be in physical contact with the outer surface of the bushing.

12. A cutting tool mounting assembly adapted for attachment to a surface of a rotatable driving member of a cutting tool machine and adapted for receiving a cutting tool, the cutting tool mounting assembly comprising:

a base configured for receiving the cutting tool and having a bottom portion for attachment to the surface of the rotatable driving member, the base having a receptacle with an inner wall for receiving the cutting tool;

a bushing inserted in the receptacle of the base and allowing the cutting tool to be rotatably disposed therein, the bushing including a forward face having an aperture for receiving the cutting tool, the bushing further including a shoulder opposite the forward face for cooperating with the front portion of the base, and a shank portion extending rearwardly from the shoulder and having an outer surface for cooperating with the inner wall of the receptacle when the bushing is inserted in the receptacle; and means for acquiring operation data, wherein the means for acquiring operation data is positioned external to and in physical contact with the bushing such that a longitudinal axis of means for acquiring operation data is substantially parallel to the central longitudinal axis of the cutting tool; and wherein the base is configured to permit the cutting tool to rotate about a central longitudinal axis of the cutting tool.

13. The cutting tool mounting assembly of claim 12, further including means for transmitting data from the means for acquiring operation data.

14. The cutting tool mounting assembly of claim 12, further including means for processing data from the means for acquiring operation data.

15. The cutting tool mounting assembly of claim 12, wherein the means for acquiring operation data has a longitudinal axis that extends substantially parallel to the central longitudinal axis of the cutting tool.

16. The cutting tool mounting assembly of claim 12, wherein the means for acquiring operation data is adjacent the receptacle of the base, and wherein a portion of the means for acquiring operation data extends through the receptacle so as to be in physical contact with the outer surface of the bushing.

* * * * *